US009655438B1

(12) United States Patent
Shoenfeld et al.

(10) Patent No.: US 9,655,438 B1
(45) Date of Patent: May 23, 2017

(54) ERGONOMIC TWO-TIER WORK STATION WITH HEIGHT-ADJUSTABLE WORK PLATFORMS

(71) Applicants: Norman A. Shoenfeld, Cypress, TX (US); Chris Childs, Pen Argyl, PA (US); Brian Shoenfeld, Cypress, TX (US)

(72) Inventors: Norman A. Shoenfeld, Cypress, TX (US); Chris Childs, Pen Argyl, PA (US); Brian Shoenfeld, Cypress, TX (US)

(73) Assignee: S&S X-Ray Products, Inc., Pen Argyl, PA (US)

( * ) Notice: Subject to any disclaimer, the term of this patent is extended or adjusted under 35 U.S.C. 154(b) by 0 days.

(21) Appl. No.: 15/292,683

(22) Filed: Oct. 13, 2016

(51) Int. Cl.

| | |
|---|---|
| ***A47B 9/20*** | (2006.01) |
| ***A47B 21/02*** | (2006.01) |
| ***A47B 21/06*** | (2006.01) |
| ***G05B 19/402*** | (2006.01) |

(52) U.S. Cl.
CPC ..... *A47B 21/02* (2013.01); *A47B 9/20* (2013.01); *A47B 21/06* (2013.01); *G05B 19/402* (2013.01); *A47B 2021/066* (2013.01); *G05B 2219/37582* (2013.01)

(58) Field of Classification Search
CPC .. A47B 21/02; A47B 9/00; A47B 9/18; A47B 9/20; A47B 2009/185; A47B 17/02; G05B 2219/37582
See application file for complete search history.

(56) References Cited

U.S. PATENT DOCUMENTS

| | | | | |
|---|---|---|---|---|
| 5,271,320 | A * | 12/1993 | Reneau | A47B 9/04 100/147 |
| 5,322,025 | A | 6/1994 | Sherman et al. | |
| 5,339,750 | A * | 8/1994 | Smies | A47B 9/04 108/147 |
| 5,443,017 | A * | 8/1995 | Wacker | A47B 9/04 108/147 |
| 5,461,974 | A * | 10/1995 | Reneau | A47B 9/04 108/147 |
| 5,588,376 | A * | 12/1996 | Seidl | A47B 17/033 108/106 |
| 5,845,587 | A * | 12/1998 | Ditonto | A47B 21/00 108/147 |
| 6,352,037 | B1 * | 3/2002 | Doyle | A47B 9/00 108/147 |

(Continued)

*Primary Examiner* — Daniel Rohrhoff
(74) *Attorney, Agent, or Firm* — Bernhard P. Molldrem, Jr.

(57) ABSTRACT

An ergonomic work station has upper and lower work platforms disposed one above the other. These are supported on electrically actuated telescoping pedestals to allow the user to select and adjust the elevation of the work platforms individually. Position sensors within each of the pedestals sense the elevation of the upper end of the respective pedestal and provide an output to logic and motor control circuitry. This is configured to maintain the lower work platform level when the height of the lower work platform is being adjusted and to prevent the upper and lower work platforms from colliding, by maintaining at least a predetermined minimum vertical distance between the two work platforms when the lower work platform is being raised or when the upper work platform is being lowered.

12 Claims, 7 Drawing Sheets

(56) References Cited

U.S. PATENT DOCUMENTS

| | | | | |
|---|---|---|---|---|
| 6,360,675 | B1 * | 3/2002 | Jones | A47B 21/06 108/50.02 |
| 6,595,144 | B1 * | 7/2003 | Doyle | A47B 9/00 108/147 |
| 8,087,737 | B2 | 1/2012 | Shoenfeld | |
| 9,504,316 | B1 * | 11/2016 | Maxwell | A47B 21/02 |
| 2005/0016806 | A1 * | 1/2005 | Klinke | A47B 9/20 188/371 |
| 2008/0245279 | A1 * | 10/2008 | Pan | A47B 9/00 108/144.11 |
| 2008/0289545 | A1 * | 11/2008 | Picchio | A47B 87/002 108/106 |
| 2011/0120351 | A1 * | 5/2011 | Shoenfeld | A47B 21/02 108/20 |
| 2014/0360413 | A1 * | 12/2014 | Schenk | A47B 87/002 108/50.11 |

* cited by examiner

ERGONOMIC TWO-TIER WORK STATION WITH HEIGHT-ADJUSTABLE WORK PLATFORMS

BACKGROUND OF THE INVENTION

This invention relates workstations for daily use which provide adjustable support for one work platform for video monitors on which images are presented, and also provide another adjustable work platform that supports keyboard, mouse, trackball, or human-computer interface control features. The invention is more particularly concerned with ergonomic radiology workstations of this type which include a feature that both permits independent adjustment of the elevation or height of the two work platforms, but also prevents the two from colliding with one another as a result of raising or lowering of either of them.

One important application for work stations or desks of this type is in filmless radiology, in which digital X-ray or other radiological images are displayed on one or more video screens or monitors, usually positioned at an upper or rear work table or platform, and where the radiology professional uses the lower or front work table or platform to interact with keyboard or similar devices.

As a general matter, there is no "one-size-fits-all" solution for radiology workstations or for workstations employed in other environments. Users need to be able to adjust the position of the monitors and of the keyboard (and other interface devices) for the work session, to achieve optimal posture and to avoid fatigue. To achieve optical ergonomics, the conditions of the workspace, ambient lighting, and ergonomic set-up of the keyboard, monitors and seating, must all be taken into account for each user. The height of the monitors relative to the user can be adjusted to reduce the requirement for head and body movement in reading the radiological images, and the height of the table or platform of the monitor should be adjusted relative to the user's seating to optimize comfort and reduce arm and upper body fatigue. For these reasons, a number of workstations have been proposed with a rear or upper platform on which the video monitor or monitors are positioned, and a front or lower platform on which the keyboard and mouse or trackball are positioned. Electric gearmotors or similar devices are installed for adjusting the height of the front and rear platforms for the user's comfort and to reduce fatigue factors. The workstation has a base that rests on the floor, and a pedestal or pedestals, i.e., vertical columns or legs, which include a height adjustment feature, on which the front and rear work platforms, i.e., lower and upper tables, are supported. In some work stations, there can be separate independent vertical supports for the two work platform. In other work stations, the there can be a main vertical support pedestal for one table or platform, and an arm or arms that support the other work platform from the main pedestal, and allow for controlled motorized height adjustment of the first work table or platform.

These workstations are frequently used by a number of different users, e.g., radiology professionals during the day, with each having his or her own height requirement for both the monitor platform and the keyboard platform. The workstations may have up/down controls for both the rear and front platforms, so that these height adjustments can be made easily for each radiologist or other user at the commencement of the work session. In some work stations, the settings can be stored or programmed, and then the necessary adjustments made automatically for each individual.

Because each work station is used by a number of different people, it would be advantageous to disinfect or sanitize the parts of the work station that are touched by the hands, namely, the human-machine interface devices such as the keyboard and mouse. A separate, stand-alone keyboard and mouse sterilizing device has been described in U.S. Pat. No. 6,278,122, where a UV sterilization feature is provided to radiate a keyboard and mouse. A keyboard sterilization feature for an adjustable radiology workstation is described in U.S. Pat. No. 8,087,737, which is incorporated by reference herein.

Prior two-level or dual table ergonomic desks or workstations have not been able to incorporate a simple (e.g., pushbutton) means for manually controlling the raising and lowering of the two tables or platforms, and have not taken any measure to prevent the lower and upper platforms from colliding or crashing into one another when being raised or lowered, nor have they taken steps to ensure that the pedestals or legs for a given table or platform extend or retract at the same rate so that the table or platform stays level and the pedestal(s) do not jam.

OBJECTS AND SUMMARY OF THE INVENTION

Accordingly, it is an object of the present invention to provide an ergonomic work station arrangement that avoids the drawbacks of the prior art, and permits the two desk tops or platforms to be moved effectively without colliding with one another either at the commencement or the end of a work session.

It is another object to provide a work station that can be easily and reliably adjusted for the users's comfort and efficiency. It is still another object to provide a two-tabletop workstation, e.g., radiology work station, that easily adjusts for height of each table top or work platform.

In accordance with an aspect of this invention, an ergonomic radiology work station is provided, for example, for a radiologist to study medical images that have been captured in digital form and displayed on one or more monitors. The work station is formed of a base adapted to rest upon the floor of the work room or work center. Various pedestal arrangement extends vertically upward from base, and supports the lower or work platform or table top, and support a lower or rear work platform or table top. The front work platform is adjustably supported from the pedestal arrangement so it can be adjusted up or down to suit the radiologist or other user.

In one favorable embodiment, An ergonomic work station has upper and lower work platforms disposed one above the other with the elevation of the upper and lower work platforms being individually adjustable. A base rests upon the floor, and left and right telescoping pedestals extending vertically upward from the left and right sides of the base. The lower work platform is supported on upper ends of said left and right pedestals. A rear telescoping pedestal (in some cases a pair of pedestals) extends vertically upward from a rearward portion of the base, and the upper work platform is supported on an upper end of this (or these) rear telescoping pedestal(s).

The left, right and rear telescoping pedestals each have an associated motorized height adjustment mechanism to allow the user to control elongation or retraction of the telescoping pedestals for positioning the respective work platforms at user-desired heights above the base. A manually actuated control mechanism is operatively coupled to the motorized height adjusting mechanisms of the left, right, and rear telescoping pedestals and provide a user interface for manually controlling up and down motion of the respective motorized height adjusting mechanisms. Position sensors within each of the left, right, and rear pedestals sensing the elevation of the upper end of the respective pedestal and provide a suitable output.

Logic and motor control circuitry for this work station has inputs connected to the manually actuated control mechanism and to the position sensors of each of the left, right, and rear telescoping pedestals, and has outputs coupled to the motorized height adjusting mechanisms of the respective left right, and rear pedestals. The logic and motor control circuitry operates to maintain the lower work platform level when it is being raised or lowered and also prevents the upper and lower work platforms from colliding, by maintaining at least a predetermined minimum vertical distance between the upper and lower work platforms when the lower work platform is being raised or when the upper work platform is being lowered.

In a preferred embodiment, the left and right telescoping pedestals each have a lower portion mounted on base, with a hollow interior, and have an upper portion that moves slidably up or down in the lower portion. The associated motorized height adjustment mechanism can include an electro-mechanical linear actuator for vertically extending the upper portion relative to the lower portion. Potentiometer feedback can serve as vertical position sensors for the left and right telescoping pedestals, with the potentiometer feedback serving as outputs for the motorized height adjustment mechanisms to correspond to the amount that the linear actuator has vertically extended the upper portion of the respective pedestal.

The rear telescoping pedestal likewise has a lower portion mounted on the base and has a hollow interior, and an upper portion that moves slidably in the lower portion. The associated motorized height adjustment mechanism for the rear pedestal also includes a motor-driven linear actuator for vertically extending upper portion relative to said lower portion of the pedestal. The position sensor, e.g., potentiometer feedback, of the rear telescoping pedestal is operatively coupled to the motorized height adjustment mechanism thereof to provide its output to the logic and motor control circuitry to correspond to the amount that the linear actuator has vertically extended the upper portion of the rear pedestal.

Favorably, the rear telescoping pedestal projects upward through a cutout in the lower work platform, i.e., through a press-fitted sleeve in the lower work platform, and the rear pedestal extending upper portion, at least, fits slidably though it. This assists in holding the upper work platform at a stable position.

A lighting panel, e.g., LED panel, may be mounted to an underside of the upper work platform to help illuminate the interface devices on the lower work platform.

The manually actuated control mechanism can be implemented a switch panel having first and second manual up/down switches for raising and lowering the lower work platform and the upper work platform, respectively.

The logic and motor control circuitry is operative to move the motorized height adjusting mechanism of the left pedestal, right pedestal, and rear pedestal such that when the lower work platform is raised to approach or reach the predetermined minimum distance from the upper work platform, the motorized height adjusting mechanism of the rear pedestal is automatically caused to move to maintain the distance between said upper and lower work platforms at or above the predetermined minimum distance. Likewise, the logic and motor control circuitry is operative to move the motorized height adjusting mechanism of the left, right, and rear pedestals such that when the upper work platform is lowered to reach or approach the aforesaid predetermined minimum distance from the lower work platform, the motorized height adjusting mechanisms of said left and right pedestals are automatically caused to move the lower work platform downward to maintain the distance between said upper and lower work platforms at or above the aforesaid predetermined minimum distance.

The two-level or two-top height-adjustable workstation of this invention thus has these important features and advantages:

1. Tiered 2-table electric adjustable-height desk.
2. Top and bottom table or work platforms that move independently.
3. Operator-actuable motion of the bottom and/or top work platforms using an up/down toggle switch, i.e., one up/down toggle switch for each table.
4. Each table is lifted electrically using electro-mechanical linear actuators.
5. Two actuators raises/lowers the bottom table and one actuator raises/lowers the top table.
6. All actuators are controlled by a single control system.
7. The control system maintains a level lower work platform or table.
   This is accomplished by moving the two actuators at the same speed based on reading potentiometer feedback position measurements from each lifting column or pedestal.
8. The top table remains level through mechanical support assist from the lower work platform or table.
   This is accomplished by traveling through a press-fit cutout in the bottom table.
9. The control system prevents collision between the bottom and top tables.
   This is accomplished by comparing the potentiometer feedback position measurements of the pedestals for the upper and lower work platforms. When the larger area lower work platform or table is raised near the top work platform or table, the upper work platform or table automatically starts to move up to maintain the distance between the tables to a set, programmable distance. Similarly, when the upper work platform or table is lowered and approaches the lower work platform or table, the lower work platform automatically to move the lower work surface down to maintain the distance between the two tables at no more than the minimum distance.
10. The control system can be mounted to a removable bracket at the back of the base.
11. Electrical power can be provided through surge protectors.
12. The under-table surge protectors' power cables are securely routed inside the lifting columns using cable carriers.
13. The operator can access the cable carriers by removing the lifting column cover plates.
14. An LED panel or light-strip can provide ambient lighting underneath the upper work platform to illuminate the lower or rear platform, and reduce shadows.
15. The operator can vary the LED light using a dimmable touch-activated switch.
16. All electrical power for the control system, actuators, surge protectors, and under-table LED lighting is provided by a single surge protector, mounted behind a lifting column or pedestal that leads to a 115 VAC power-outlet.

17. The rear pedestal, i.e., for the upper work platform, has a grommet near its base to enable cable routing from the top table, through a cable carrier, to the base.
18. Each platform or tabletop includes cable management grommets to conveniently pass electrical wires and cables through the table.
19. Mounted beneath the upper work platform there may be two storage cubbies and a corkboard bulletin board.
20. A cross-member can connect all three pedestals or lifting columns and provide stability to the upper and lower work platforms.
21. The base of the work station can be supported by swivel casters, and additionally with furniture leveling feet that are accessible from above the base frame through an access cap.
22. The pedestals can support PC trays either outside or inside the left or right telescoping pedestal.
23. Floor mounting brackets may secure the metal base to the floor.
24. The frame and support structure materials are favorably powder-coat painted 1018 cold-rolled steel and, e.g., 5052-H32 aluminum sheet metal.
25. The upper and lower work platform may be constructed of medium density fibreboard (MDF), high-pressure laminate (HPL), and/or plastic T-molding.

The above and many other objects, features, and advantages of this invention will become apparent from the ensuing description of a selected preferred embodiment, which is to be considered in connection with the accompanying Drawing.

DETAILED DESCRIPTION OF THE PREFERRED EMBODIMENT

Figure 1:
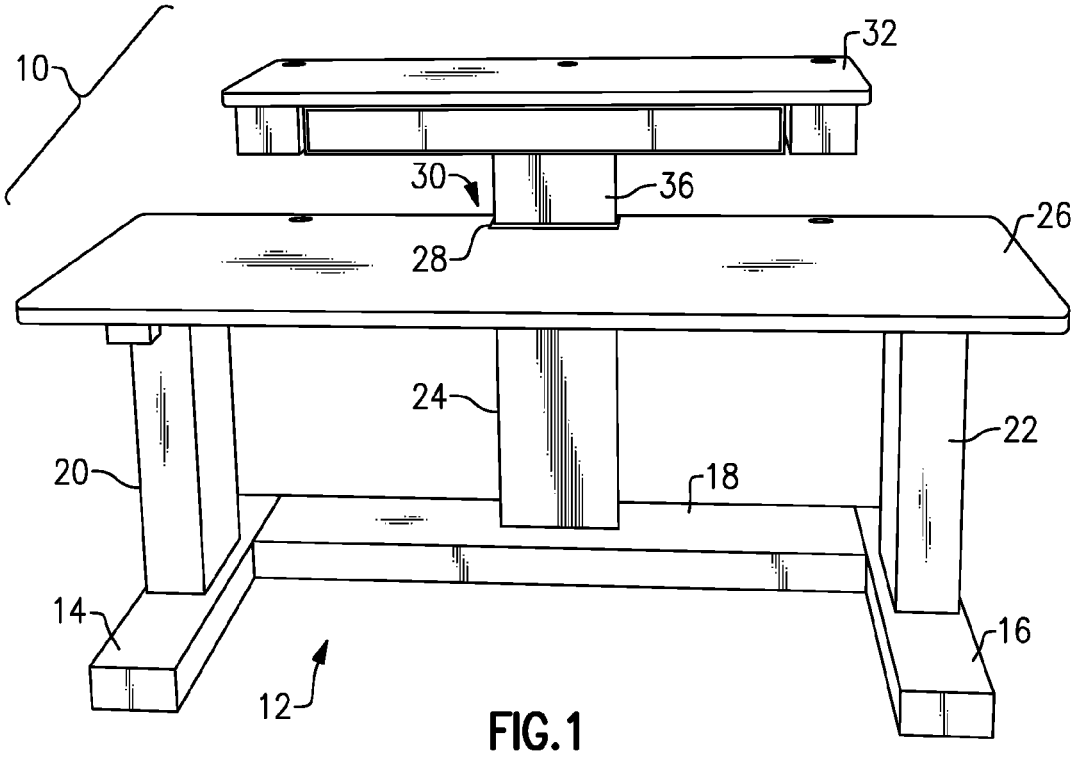
FIG. 1 is a front perspective view of an ergonomic two-work-platform work station according to one preferred embodiment of this invention.
Figure 2:
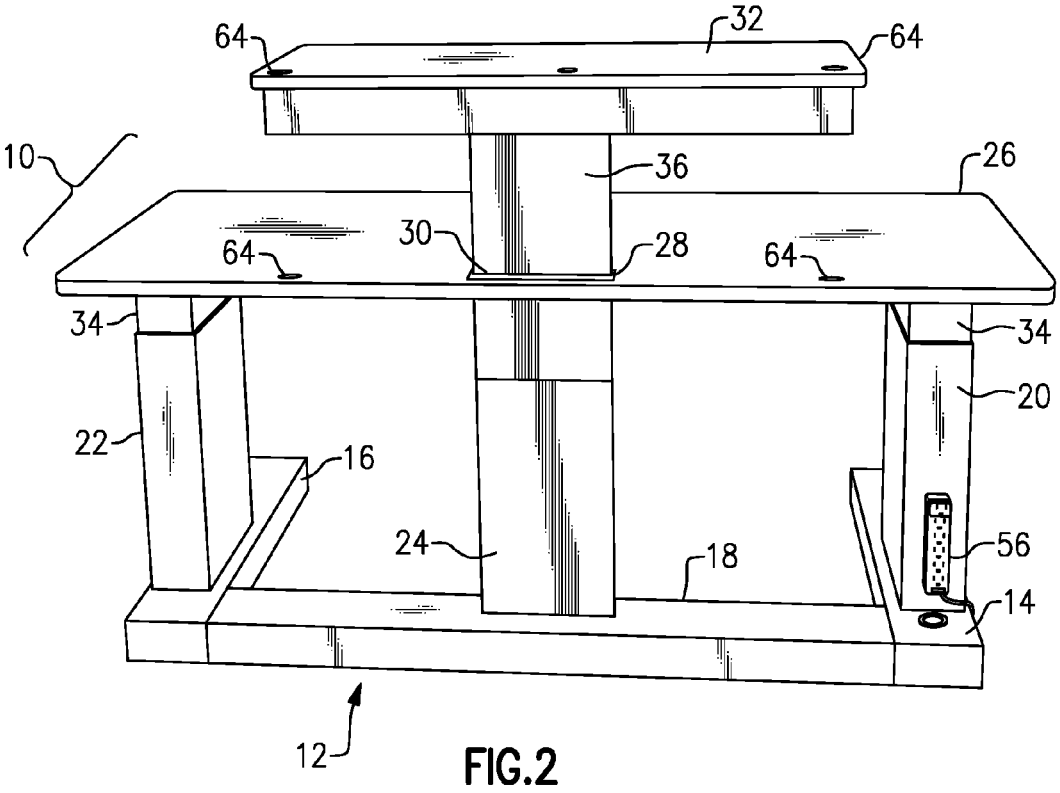
FIG. 2 is a rear perspective view thereof.

With reference to the Drawing, and initially to FIGS. 1 and 2, a two-tier electrically adjustable ergonomic work desk or work station 10 has a base 12 that rests upon the floor, e.g., the floor of the radiology study room, and in this embodiment has left and right elongated feet 14 and 16 at the left and right sides, and a rear cross member 18 connecting the left foot 14 and right foot 16 at their rear ends. These may be of metal construction with hollow interiors so as to be able to carry cords and cables. A left telescoping pedestal or leg 20 has its lower end affixed onto the left leg 14, and a right telescoping pedestal or leg 22 is affixed onto the right foot 16 of the base 12. These rise vertically and support left and right sides of a lower or front work table or platform 26. A rear telescoping pedestal 24 is affixed onto the rear cross member 18 of the base, at or near its center, and this rises vertically and supports an upper or rear horizontal work platform 32. In this embodiment, a telescoping portion of the rear leg passes through a steel sleeve 28 of generally rectangular profile that is fitted into a rectangular opening 30 that passes through the lower or front work platform 26. The upper or rear work platform 32 may support one or two video monitors or screens (not shown here), with the lower or front work platform 26 supporting a keyboard, mouse, and/or other human interface devices.

Each of the left and right pedestals 20, 22 has a lower portion that is fixed to the respective foot 14, 16 of the base, and an upper vertically extendible slidable portion 34 that rises to support the lower platform 20. Likewise, the rear pedestal 24 has a lower portion that is affixed to the center of the rear cross member 18 of the base 10, and a sliding upper portion 36 that can be vertically extended or retracted. The height or vertical position of the lower work platform or table 26 can be adjustable to position it at an optimal ergonomic position for the user. Likewise, the height of the upper work platform 32 can be independently raised and lowered for optimal viewing for that user. The pedestals 20, 22, and 24 are motorized and controlled so that the top of the table or platform 26 is kept level when it is being moved vertically up or down, and so that the two work platforms 26 and 32 do not collide with one another when either the lower work platform 26 is being raised or when the upper platform 32 is being lowered, as will be discussed shortly.

The two pedestals 20 and 22 each have a lower part that is affixed to the respective foot 14, 16 of the base, and an upper part 34 that slides to extend or retract vertically, with the upper end supporting the respective right or left side of the work platform 26 at a user-selected height. As also shown in FIG. 2, the lower part of the rear telescoping pedestal 24 is affixed directly onto the upper surface of the rear cross member 18, and a telescoping, i.e., extendible and retractable upper slide portion 36 passes through the sleeve 28 and opening 30 of the lower platform 26 to support the upper work platform 32. This arrangement provides some lateral support to the pedestal 22 and to the upper platform 32 that it is connected to.

Figure 3:
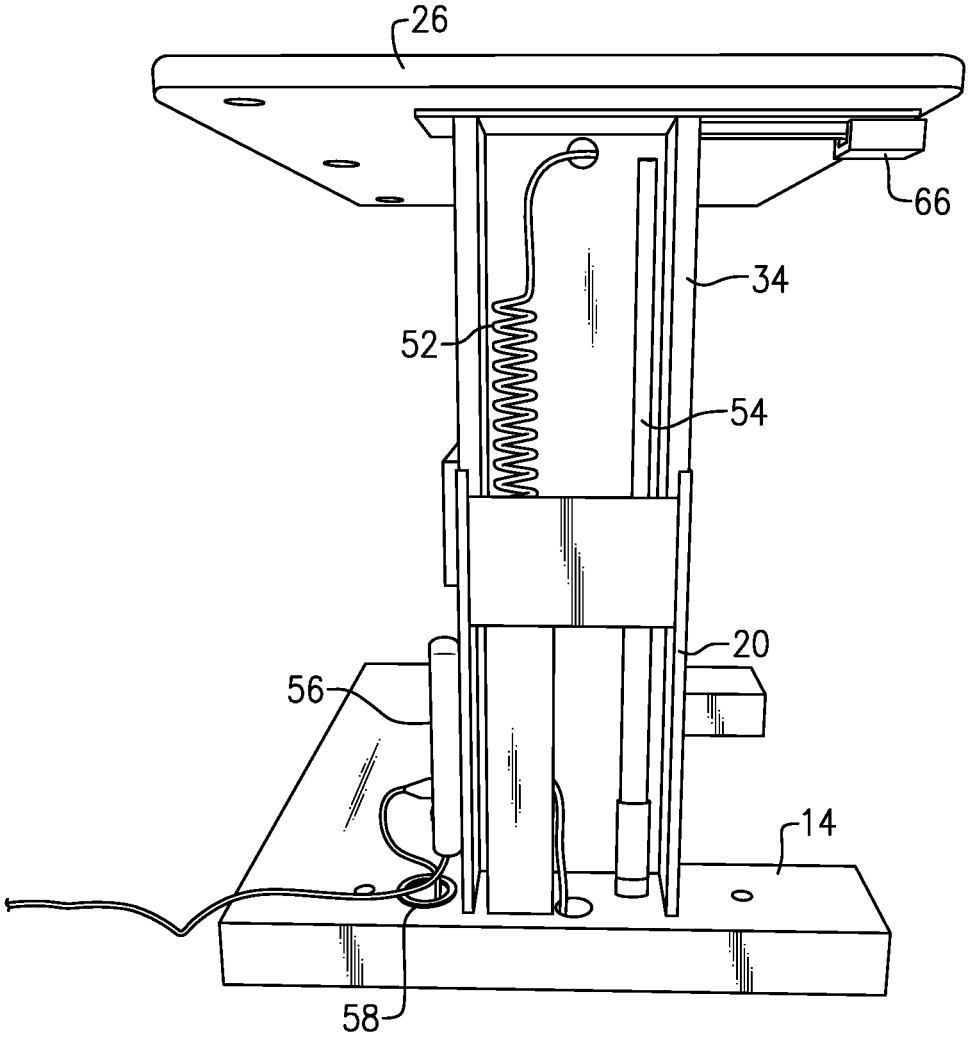
FIG. 3 is a left-side perspective thereof, with a cover panel removed from the support pedestal to reveal cabling and linear actuator within the pedestal.

As illustrated in FIG. 3, the left pedestal 20 is shown here (with a cover having been removed to expose the hollow interior) being formed of a lower channel member 48 of generally rectangular section being affixed to the base 12 and an upper telescoping member 50 that can extend from or retract into the lower channel member 48. An electric or signal cable, or a number of cables, here represented as a coiled cable 52 may be situated in the interior of the leg or pedestal to bring power and signal to a device or devices on the work desk. Also shown here is a motorized linear actuator 54 with a motor drive that serves as the mechanism for extending the upper slide 34 of the pedestal. The linear actuator includes a potentiometer feed back provision, or other equivalent means to provide a feedback signal to allow the extension of the actuator 54 (and height or elevation of the work platform 26) to be measured and controlled. A power strip 56 may be mounted onto the rear or distal side of the vertical pedestal 20. This provides a convenient place for the user to plug in electrical cords from the computers, monitors, or other devices. The other two pedestals (not shown here) could have a construction similar to that of FIG. 3.

From one to four video monitors may be supported on the upper or rear work platform 32, and these may be coupled to a work station computer (not shown here) which may be supported on a tray or the like mounted either on the base 10 or onto the lower part of the left (or right) pedestal. A number of grommets 64 are provided at the rear of each of the upper and lower tables to facilitate cable management. A control mechanism for controlling up and down motion of the two work platforms 26, 32 and coupled to each of the linear actuators 54, can be located within the base 10 or within the housing of one of the pedestals.

Figure 4:
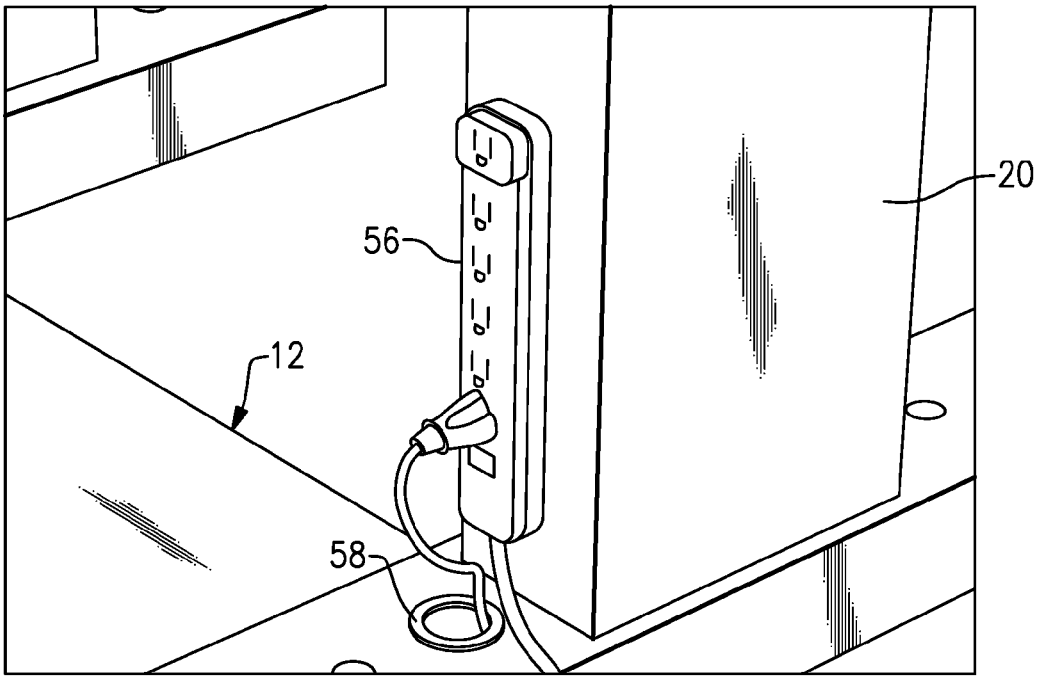
FIG. 4 is a perspective view of a portion of one of the pedestals of the work station.

Detail of the lower part of the pedestal 20 and base 12 of his embodiment is shown in FIG. 4, showing the positioning of the power strip 56. Power cords to the monitors, screens, computers and other electronic appliances can extend along a hidden cable run within the hollow pedestals and base, and emerge via a grommet 58 to plug into the power strip 56.

Figure 5:
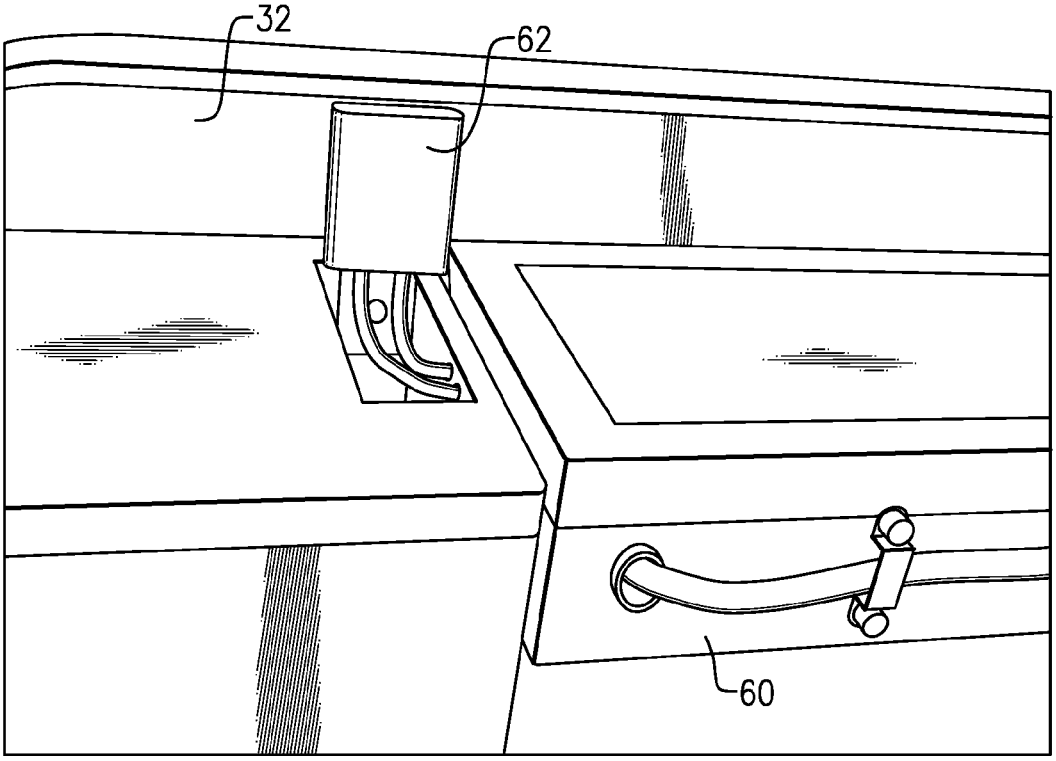
FIG. 5 is a view of the underside of the upper or front work platform.

An underside of the top or upper work platform 32, as viewed from below, is shown in FIG. 5. A lighting panel 60 is disposed at the under surface of the platform 32, and can favorably be include a panel of LEDs of a suitable color or color temperature. These can be oriented by the user to illuminate the upper surface of the lower or front work platform 24 to bathe the keyboard and other items in a gentle illumination and reduce eye strain for the user. A touch control device 62 is shown mounted just beneath the front edge of the upper platform 32. When the user touches this with the fingers, the illumination level will change gradually to the level the user desires.

Figure 6:
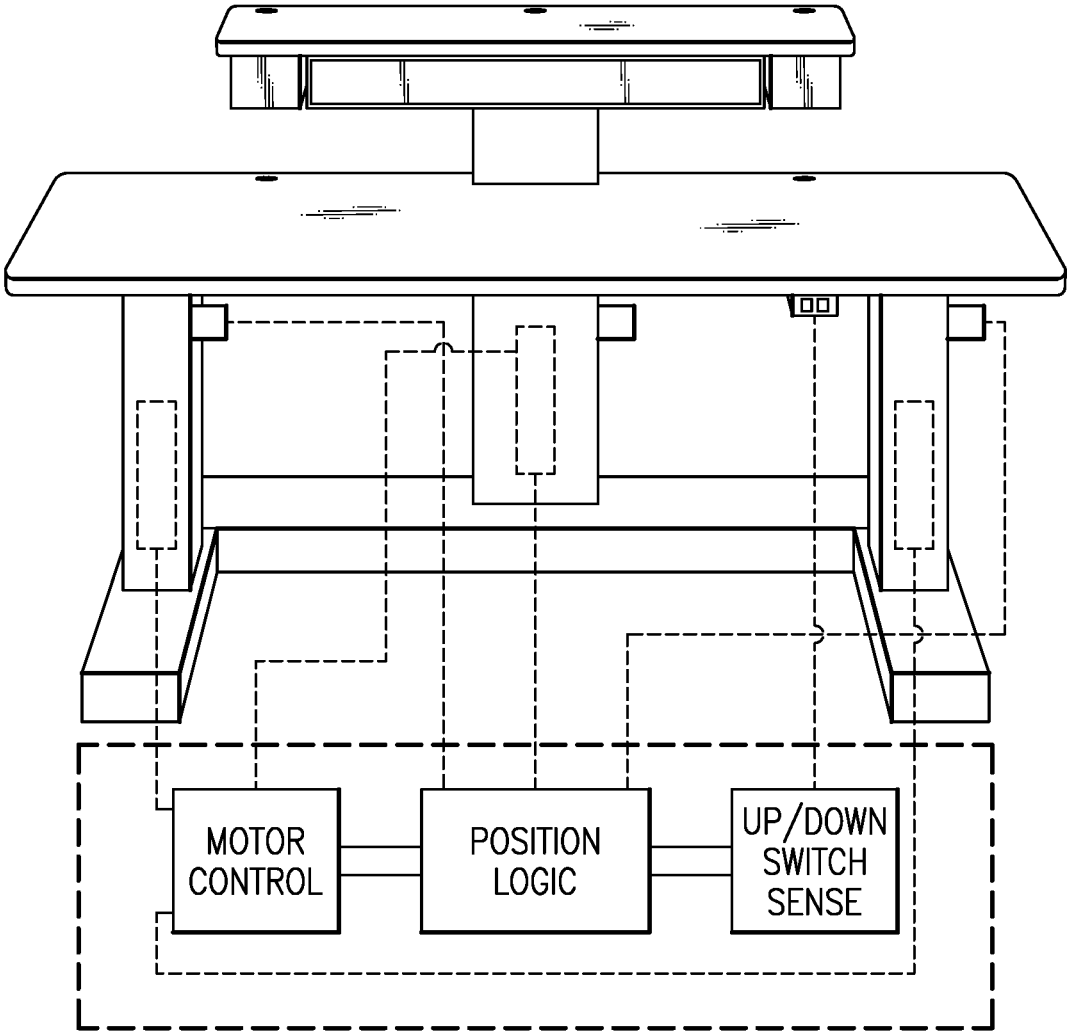
FIG. 6 is a view schematically illustrating switching, position logic, and motor control functions of this embodiment.

FIG. 6 schematically superimposes a logic and control circuitry 70 onto the work station 10. The logic and control circuitry controls the up and down motion of the upper and lower work platforms 32 and 24, to maintain the lower platform 24 level and to ensure that the upper and lower platforms 32 and 24 do not collide with one another. Within the logic and control circuitry 70, an up/down switch sense portion has an input or inputs coupled with a dual up/down rocker switch arrangement 66 which here is positioned just beneath the front edge of the lower or front work platform 24. In this switch arrangement, the left rocker switch is actuated to move the lower or front platform up and down, and the right rocker switch is actuated to move the upper or rear platform up and down. Each rocker switch reverts to a normal neutral (off) position when the user removes his or her hand from the switch. A position logic portion 74 is coupled to receive a potentiometer feed back signal from a potentiometer portion 55 of the respective linear actuator 54 for each given telescoping pedestal 20, 22, 24. The up/down switch sense information and the pedestal position information are fed to a motor control portion 76 which provides appropriate motor drive current to each of the motorized linear actuators 54. The controlled drive current to each actuator is varied as necessary to ensure that the right and left ends of the platform 26 are within a small error distance of one another, so as to maintain the work platform level during vertical travel in either direction. At the same time, the motor control portion 76 of the logic and control circuit 70 constantly compares the potentiometer feedback signal from actuator of the pedestal 24 with those of the right and left pedestals 20 and 22. When these indicate that the vertical positions of the upper and lower work platforms are at or within a predetermined minimum vertical separation, e.g., ten inches, the motor control portion will send drive current to move the one or other work platform so as to maintain that vertical separation. For example, when the lower work platform 24 is raised to within this predetermined vertical separation, the motor control portion will energize the actuator 54 of the rear pedestal 24 to lift the upper platform 32 and maintain that separation. When the upper work platform 32 is being lowered, and is sensed to be at or within that separation from the lower work platform 26, then the motor control portion 76 will energize the actuators 54 of the left and right pedestals 20 and 22 so as to lower the work platform 26 at about the same rate and maintain the predetermined vertical separation.

Figure 7:
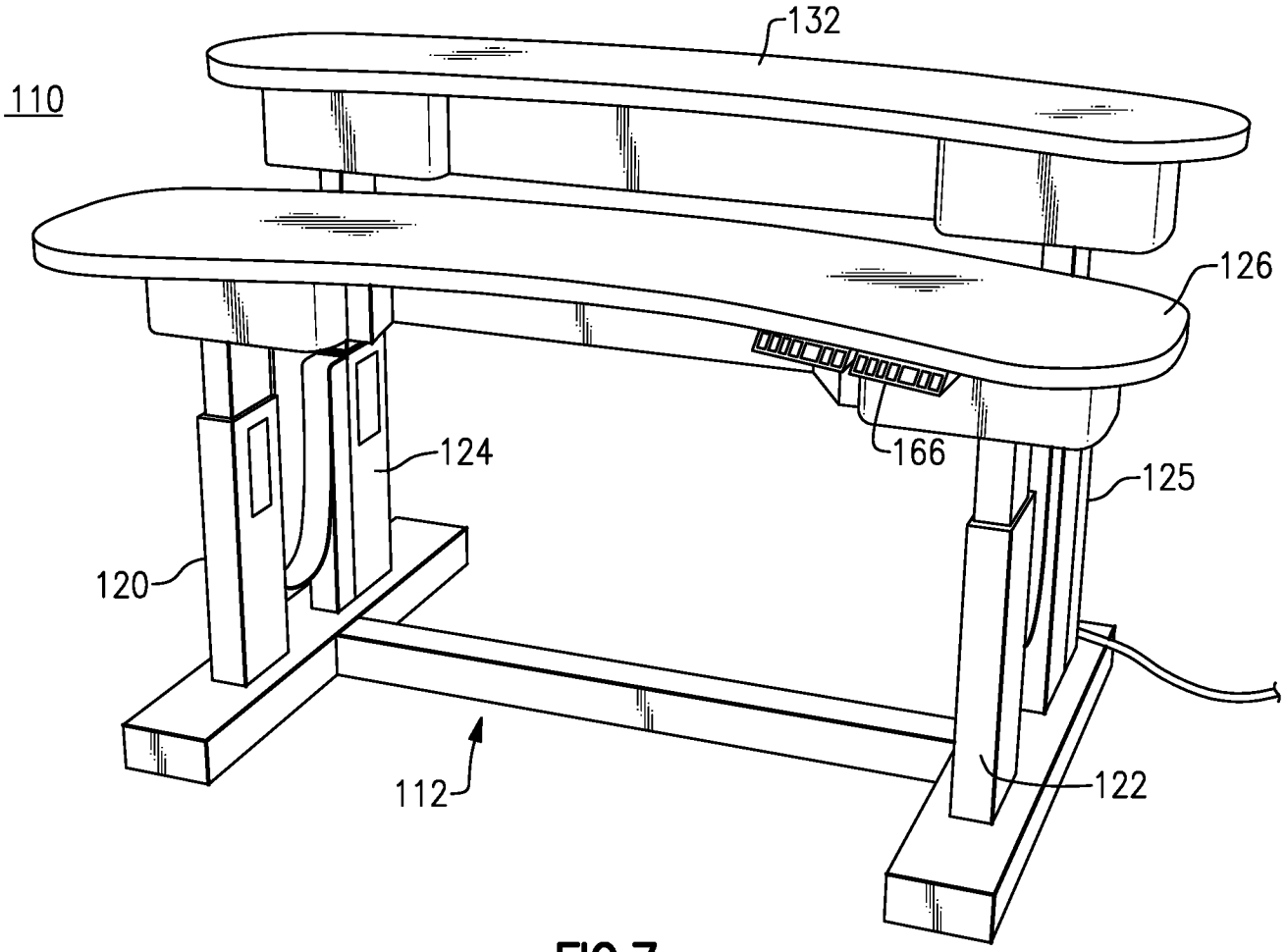
FIG. 7 is a perspective view of a second embodiment of this invention.

FIG. 7 shows another possible embodiment of this invention, namely, a two-tier adjustable height work station 110 of a different shape and design from that of the first-described embodiment, but which operates on the same principles. Elements that correspond to those of the first embodiment are identified with the same reference numbers, but raised by 100. Here the work station has a base 112 on which are affixed two pairs of telescoping support pedestals, namely forward left and right pedestals 120 and 122 which support a front or lower table or work platform 126, and rearward left and right pedestals 124 and 125 which support a rear or upper table or work platform 132. The raising and lowering for each of the two work platforms may be controlled by selecting push button switches on a switch panel 166 beneath the front edge of the lower work platform. This embodiment would also include the leveling and anti-collision features as in the first embodiment.

In other possible embodiments, there may be three independently adjustable work surfaces, or more than three, and may have similar mechanisms to maintain the work platforms level during vertical travel, and to prevent the work platforms from colliding with one another. In the disclosed embodiment and in many other possible embodiments, the hollow telescopic legs or pedestals may contain a cable-carrying mechanism. This hidden cable carrier can handle the power cables, monitor cables, and any USB or other cables that run between the PC or computer that is mounted below at the base, and the monitors and keyboards that are positioned on the table tops or platforms above. This system keeps the cables out of sight and safe during vertical motion of the table tops. The enlarged cross section that permits channels for the cables also makes the legs or pedestals more stable and sturdier.

While the invention has been described hereinabove with reference to a selected preferred embodiment, it should be recognized that the invention is not limited to that precise embodiment. Rather, many modification and variations would present themselves to persons skilled in the art without departing from the scope and spirit of this invention, as defined in the appended claims.

We claim:

1. An ergonomic work station with upper and lower work platforms disposed one above the other and in which elevation of said upper and lower work platforms are individually adjustable, comprising:

a base adapted to rest upon a floor;

left and right telescoping pedestals extending vertically upward from left and right sides of said base, said lower work platform being supported on upper ends of said left and right pedestals;

at least one rear telescoping pedestal extending vertically upward from a rearward portion of said base, said upper work platform being supported on an upper end of said at least one rear telescoping pedestal;

said left, right and rear telescoping pedestals each including a motorized height adjustment mechanism therein for controllably positioning the respective work platforms respectively at desired heights above said base;

a manually actuated control mechanism operatively coupled to the motorized height adjusting mechanisms of said left, right, and rear telescoping pedestals for manually controlling up and down motion of the respective motorized height adjusting mechanisms;

position sensors within each of said left, right, and rear pedestals for sensing the elevation of the upper end of the respective pedestal and providing a respective output;

logic and motor control circuitry having inputs connected to said manually actuated control mechanism and to the position sensors of said left, right, and rear telescoping pedestals, and outputs coupled to the motorized height adjusting mechanisms of the respective left right, and rear pedestals;

the logic and motor control circuitry being operative to maintain the lower work platform level when the height of the lower work platform is being adjusted and to prevent the upper and lower work platforms from colliding by maintaining at least a predetermined minimum vertical distance between said upper and lower work platforms when said lower work platform is being raised and when said upper work platform is being lowered.

2. The work station according to claim 1, wherein said left and right telescoping pedestals each have at least a lower portion mounted on said base and having a hollow interior, and an upper portion that moves slidably in the lower portion, the respective motorized height adjustment mechanism thereof includes an electro-mechanical linear actuator for vertically extending said upper portion relative to said lower portion.

3. The work station according to claim 2, wherein the position sensors of said left and right telescoping pedestals are operatively coupled to said motorized height adjustment mechanisms respectively to provide the respective output that corresponds to the amount that the linear actuator has vertically extended the upper portion of the respective pedestal.

4. The work station according to claim 1, wherein said at least one rear telescoping pedestal has a lower portion mounted on said base and having a hollow interior, and an upper portion that moves slidably in the lower portion, the respective motorized height adjustment mechanism thereof includes a motor-driven linear actuator for vertically extending said upper portion relative to said lower portion.

5. The work station according to claim 1, wherein the position sensor of said rear telescoping pedestal is operatively coupled to the motorized height adjustment mechanism thereof to provide its output so as to correspond to the amount that the linear actuator has vertically extended the upper portion of the rear pedestal.

6. The work station according to claim 1, wherein said at least one rear telescoping pedestal projects upward through a cutout in the lower work platform.

7. The work station according to claim 6, wherein said cutout includes a press-fitted sleeve fitting slidably therethrough said rear pedestal.

8. The work station according to claim 1, comprising an LED light source mounted to an underside of said upper work platform.

9. The work station according to claim 1, wherein said manually actuated control mechanism includes a switch panel having first and second manual switches for raising and lowering said lower work platform and said upper work platform, respectively.

10. The work station according to claim 1, wherein said position sensors provide their respective outputs as potentiometer feedback position measurements of the respective telescoping pedestals, and said logic and motor control circuitry is operative to move the motorized height adjusting mechanism of the left and right telescoping pedestals at the same speed based on said potentiometer feedback position measurements.

11. The work station according to claim 1, wherein said logic and motor control circuitry is operative to move the motorized height adjusting mechanism of the left pedestal, right pedestal, and at least one rear pedestal such that when the lower work platform is raised to said predetermined minimum distance from said upper work platform, the motorized height adjusting mechanism of said at least one rear pedestal is automatically caused to move to maintain the distance between said upper and lower work platforms at or above said predetermined minimum distance.

12. The work station according to claim 1, wherein said logic and motor control circuitry is operative to move the motorized height adjusting mechanism of the left pedestal, right pedestal, and at least one rear pedestal such that when the upper work platform is lowered to said predetermined minimum distance from said lower work platform, the motorized height adjusting mechanisms of said left and right pedestals are automatically caused to move to maintain the distance between said upper and lower work platforms at or above said predetermined minimum distance.

* * * * *